US009505018B2

(12) United States Patent
Vogtner et al.

(10) Patent No.: US 9,505,018 B2
(45) Date of Patent: Nov. 29, 2016

(54) LIGHTED WATERFALL DEVICE

(71) Applicant: Custom Molded Products, Inc., Newnan, GA (US)

(72) Inventors: Zachary Vogtner, Atlanta, GA (US); Richard Simpson, Tyrone, GA (US)

(73) Assignee: Custom Molded Products, Inc., Newnan, GA (US)

( * ) Notice: Subject to any disclaimer, the term of this patent is extended or adjusted under 35 U.S.C. 154(b) by 601 days.

(21) Appl. No.: 13/663,988

(22) Filed: Oct. 30, 2012

(65) Prior Publication Data

US 2014/0117107 A1 May 1, 2014

(51) Int. Cl.

| | |
|---|---|
| ***F21S 10/00*** | (2006.01) |
| ***B05B 17/08*** | (2006.01) |
| ***F21V 33/00*** | (2006.01) |
| ***F21S 8/00*** | (2006.01) |
| ***F21S 10/02*** | (2006.01) |
| *F21Y 101/02* | (2006.01) |
| *F21W 121/02* | (2006.01) |

(52) U.S. Cl.

CPC ..... *B05B 17/085* (2013.01); *F21S 8/00* (2013.01); *F21S 10/02* (2013.01); *F21V 33/004* (2013.01); *F21W 2121/02* (2013.01); *F21Y 2101/02* (2013.01)

(58) Field of Classification Search

CPC .... B05B 1/04; B05B 17/085; F21Y 2101/02
USPC ..... 239/17, 18; 4/496, 507; 362/96
See application file for complete search history.

(56) References Cited

U.S. PATENT DOCUMENTS

| | | | | |
|---|---|---|---|---|
| 4,901,922 | A * | 2/1990 | Kessener et al. | 239/12 |
| 6,484,952 | B2 * | 11/2002 | Koren | 239/18 |
| 7,384,165 | B2 * | 6/2008 | Doyle | 362/101 |
| 2010/0195309 | A1 * | 8/2010 | Cieslak | 362/96 |

* cited by examiner

*Primary Examiner* — Arthur O Hall
*Assistant Examiner* — Viet Le
(74) *Attorney, Agent, or Firm* — Laurence P. Colton; Smith Tempel Blaha LLC

(57) ABSTRACT

A lighted waterfall apparatus for producing an artificial waterfall having a waterfall apparatus including a chamber for containing a removable light source and a port for accessing the light source, such that the light source can be easily accessed, inserted, removed, and/or replaced.

15 Claims, 19 Drawing Sheets

LIGHTED WATERFALL DEVICE

BACKGROUND OF THE INVENTION

1. Technical Field

The present invention generally is in the field of devices for generating waterfalls, and more particularly is in the field of devices for generating aesthetically pleasing lighted waterfalls in spas, swimming pools, hot tubs, garden baths, and the like.

2. Prior Art

Few applications derive more benefit from the addition of waterfalls or fountains than artificial bodies of water such as spas, swimming pools, hot tubs, garden baths, and the like. The popularity of waterfalls and fountains in such structures is probably associated with the numerous aesthetic and practical applications that make waterfalls desirable. More specifically, the addition of a waterfall or fountain to an artificial body of water can provide a substantial decorative effect or can provide a relaxing background sound, generated from the water flow. As such, users and owners of artificial bodies of water often desire the addition of waterfalls or fountains.

Many existing waterfall apparatuses also include some type of lighting feature to add to the aesthetics of the device. In some existing waterfall apparatuses, the lighting feature is located near either the device or where water emanating from the device impacts the water in the artificial body of water. In such locations, the water itself often is not completely or sufficiently lighted. In other existing waterfall apparatuses, the lighting feature is located within the device so as to shine into the water as it emanates from the device. In such locations, the water can be more completely or more sufficiently lighted, but also often not completely or sufficiently lighted. Also, in such devices, it can be difficult to replace malfunctioning lights, as the device typically is permanently embedded within a wall proximal to the artificial body of water. As such, prior art lighted waterfall apparatuses can be relatively costly and/or difficult to maintain.

Accordingly, there is a need for a lighted waterfall apparatus that allows for the addition of a lighted waterfall to an artificial body of water, such as a spa, swimming pool, hot tub, garden bath, or the like with a minimum of manufacturing and installation costs. There also is a need for such a lighted waterfall apparatus that provides satisfactory lighting to the water emanating from the waterfall apparatus. There is also a need for such a lighted waterfall apparatus to be able to be permanently integrated into a spa, swimming pool, hot tub, garden bath, or the like yet still allow for the simple and inexpensive replacement of the light generating components. It is to these needs and others that the present invention is directed.

BRIEF SUMMARY OF THE INVENTION

Briefly described, the present invention is a lighted waterfall apparatus that produces a waterfall into a spa, swimming pool, hot tub, garden bath, or the like, and that incorporates a removable and replaceable lighting unit so that, for example, the lighted waterfall apparatus can be permanently mounted yet allow the simple replacement of the lighting unit. Additionally, the present invention is a lighted waterfall apparatus that produces a lighted waterfall into a spa, swimming pool, hot tub, garden bath, or the like, that provides satisfactory lighting to the water emanating from the waterfall apparatus. More specifically described, the present invention provides a structure and means for maintaining the lighting unit of a lighted waterfall apparatus by allowing the easy and quick removal of the lighting unit from the spa, swimming pool, hot tub, garden bath, or the like without removing the lighted waterfall apparatus from the spa wall or having to access behind the spa wall. For simplicity, spa, swimming pool, hot tub, garden bath, or the like, and all such reservoirs and artificial bodies of water, together or separately will be referred to as spas or a spa.

A representative waterfall apparatus that can comprise the invention generally is a waterfall apparatus that can be installed on or proximal to the edge of a spa to provide for the addition of an aesthetically pleasing and decorative waterfall that flows into a spa. In the waterfall apparatus, water from a water source flows into the interior hollow or manifold of the waterfall apparatus and is discharged through a waterfall slot/primary outlet into the spa. A means for lighting the waterfall, and more particularly for lighting the water emanating from the waterfall apparatus, is contained within the waterfall apparatus proximal to the waterfall slot/primary outlet. Additionally, a means for accessing the means for lighting the waterfall is located at, on, or proximal to the front of the waterfall structure, preferably proximal to the waterfall slot/primary outlet, so as to allow easier access to the means for lighting. The means for accessing the means for lighting the waterfall can be a door or other covering to a chamber in which the means for lighting is retained. The chamber can have a transparent, semi-transparent, or translucent divider between the chamber and the waterfall slot/primary opening so as to allow the means for lighting to light the water emanating from the waterfall slot/primary opening yet be separated from the water in a "dry" zone.

The waterfall apparatus can be placed above the surface of the water in the spa on the upper edge of the spa wall or within the spa wall above the water level of the spa so that the waterfall can be a smooth flow of falling water extending from the waterfall apparatus to the surface of the water in the spa.

A representative waterfall apparatus of the present invention generally comprises an inlet, a primary outlet or waterfall slot, an interior manifold for holding and spreading water along the outlet, optional baffles to remove turbulence and debris from the water, a primary outlet for creating the waterfall, a chamber for the means for lighting the waterfall, and an access port to the chamber. When the waterfall apparatus is installed in the spa, the representative waterfall apparatus can appear as a generally continuous shaped structure with the waterfall slot/primary outlet in the center of the waterfall waterjet such that water emanates from the waterfall into the spa. When the means for lighting is on, light is directed to and lights the water emanating from the waterfall slot/primary outlet.

In one embodiment, the representative waterfall apparatus comprises a structure or set of structures for creating the waterfall and a chamber for the means for lighting, separated by a transparent, semi-transparent, or translucent divider so as to allow the chamber and the means for lighting to light to remain in a "dry" zone. In another embodiment, the representative waterfall apparatus comprises a structure or set of structures for creating the waterfall and a chamber for the means for lighting with no divider so as to allow the water and the means for lighting to be in direct contact. In all preferred embodiments, the chamber has an access port accessible from the front, or spa side, of the waterfall apparatus to allow access to the means for lighting so as to allow removal and/or replacement of the means for lighting without having to otherwise remove or deal with the main structure of the waterfall apparatus.

In one embodiment, the means for lighting is a strip of light emitting diodes (LEDs) and the chamber is an elongated manifold lying proximal to the waterfall slot/primary outlet. In a preferred embodiment, the waterfall slot/primary outlet is an elongated horizontal opening and the chamber is an elongated horizontal manifold located above, behind, or below the waterfall slot/primary outlet. In a more preferred embodiment, the waterfall slot/primary outlet is an elongated horizontal opening and the chamber is an elongated horizontal manifold located below the waterfall slot/primary outlet and separated from the waterfall slot/primary outlet by a transparent, semi-transparent, or translucent divider.

In use, the means for lighting can be inserted into and removed from the chamber via the access port. In this manner, if the means for light fails, the means for lighting can be easily replaced without disassembling the waterfall apparatus or the spa. Additionally, if a user decides to change the color of the means for lighting, a means for lighting of one color can be easily replaced with a means for lighting of another color without disassembling the waterfall apparatus or the spa.

The waterfall waterjet can be anchored to or contained within the wall or edge of a spa using any appropriate means as long as water is fed into, and water can flow out of, the waterfall apparatus. In one embodiment, the waterfall apparatus may be contained within the spa wall, such as within a concrete spa wall. In this embodiment, the primary outlet would face the interior of the spa (the "wet" side) and the water inlet could face in a generally opposite direction towards the mechanical components of the spa (the "dry" side). This can be considered a more permanent installation of the waterfall apparatus. In another embodiment, the waterfall apparatus may be structured to have securing ends for securing the waterfall apparatus to the spa wall. In this embodiment, the waterfall apparatus can be installed with a minimum of disturbance to the surrounding spa. This can be considered a less permanent installation of the waterfall apparatus.

The waterfall apparatus can be used on almost any artificial water body. While the waterfall apparatus is described in connection with a spa, it is understood that the waterfall apparatus can be used on spas, swimming pools, tubs, and the like. For example, the waterfall apparatus can be placed on or proximal to the edge of a swimming pool so to provide a waterfall. One of ordinary skill in the art can modify the waterfall apparatus without undue experimentation so that it can be placed on almost any artificial water body.

These features, and other features and advantages of the present invention will become more apparent to those of ordinary skill in the relevant art when the following detailed description of the preferred embodiments is read in conjunction with the appended drawings in which like reference numerals represent like components throughout the several views.

DETAILED DESCRIPTION OF THE PREFERRED EMBODIMENTS

Figure 1:
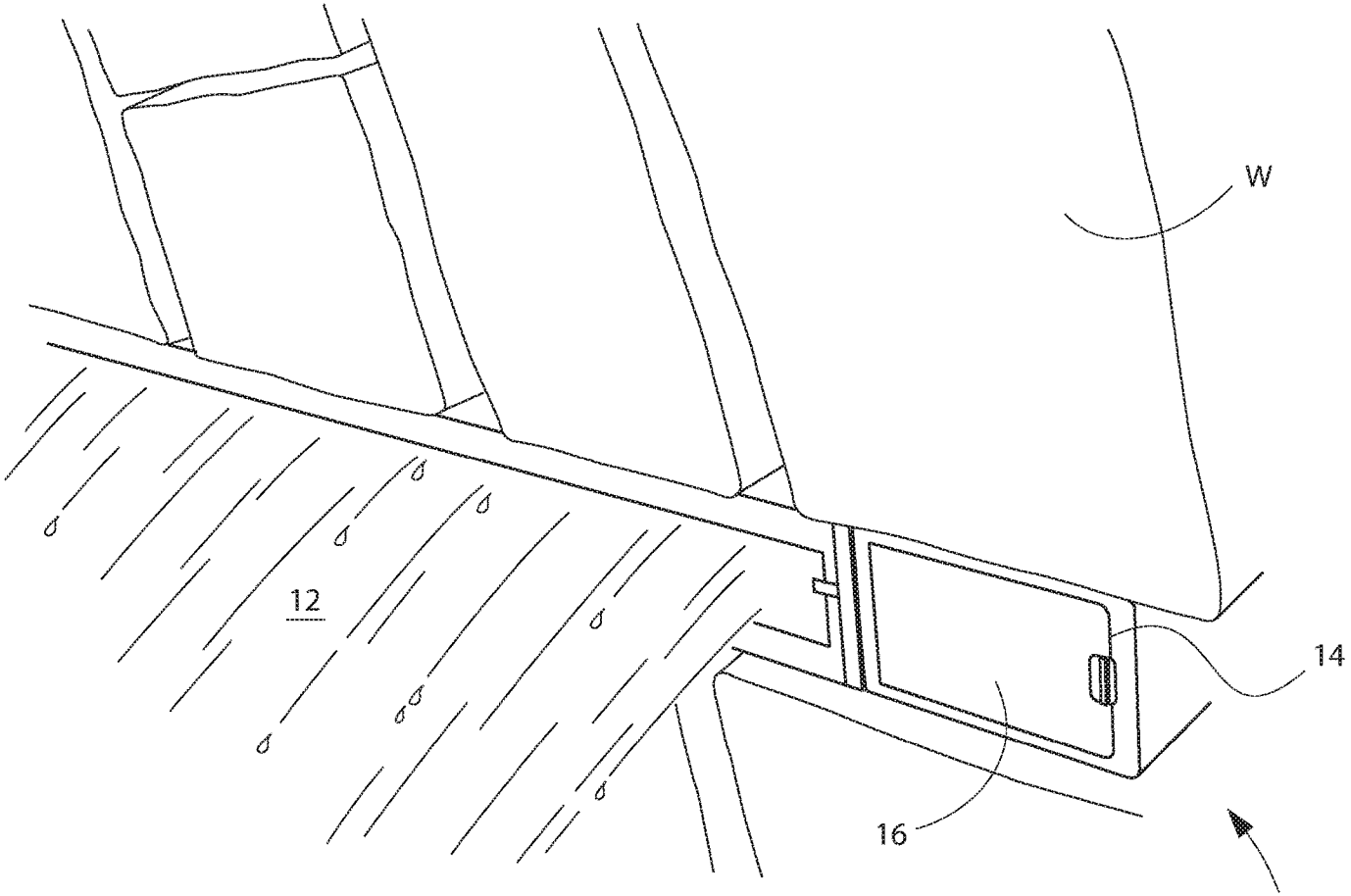
FIG. 1 is a top right perspective view of the invention in operation as mounted in a stone wall and producing a waterfall.

Illustrative embodiments of a lighted waterfall 10 according to the present invention are shown in FIGS. 1 through 11. FIG. 1 is a top right perspective view of the inventive lighted waterfall device 10 in operation as mounted in a stone wall W and producing a waterfall 12 of water. FIG. 1 also illustrates a representative placement of the port 14 and port door 16, which is a means for accessing the means for lighting 18 the waterfall 12.

Figure 2A:
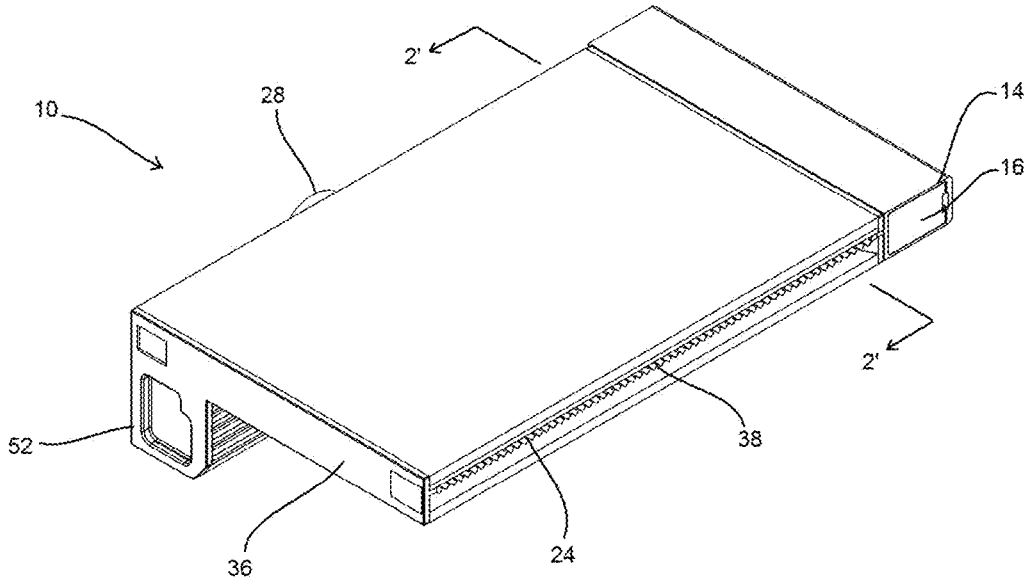
FIG. 2A is a top left perspective view of the invention.
Figure 2B:
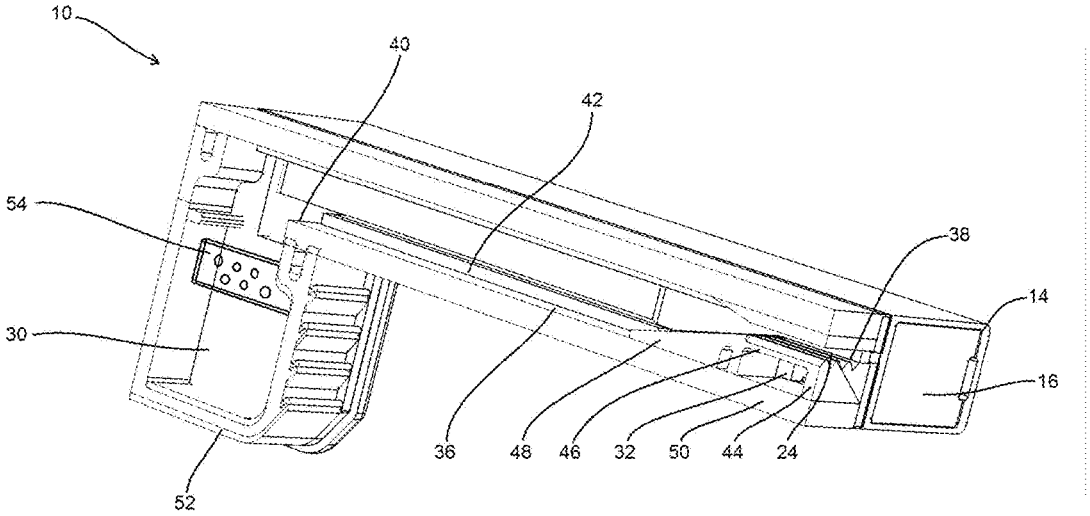
FIG. 2B is a left perspective cross section view of the invention through line 2'-2' of FIG. 2A.
Figure 2C:
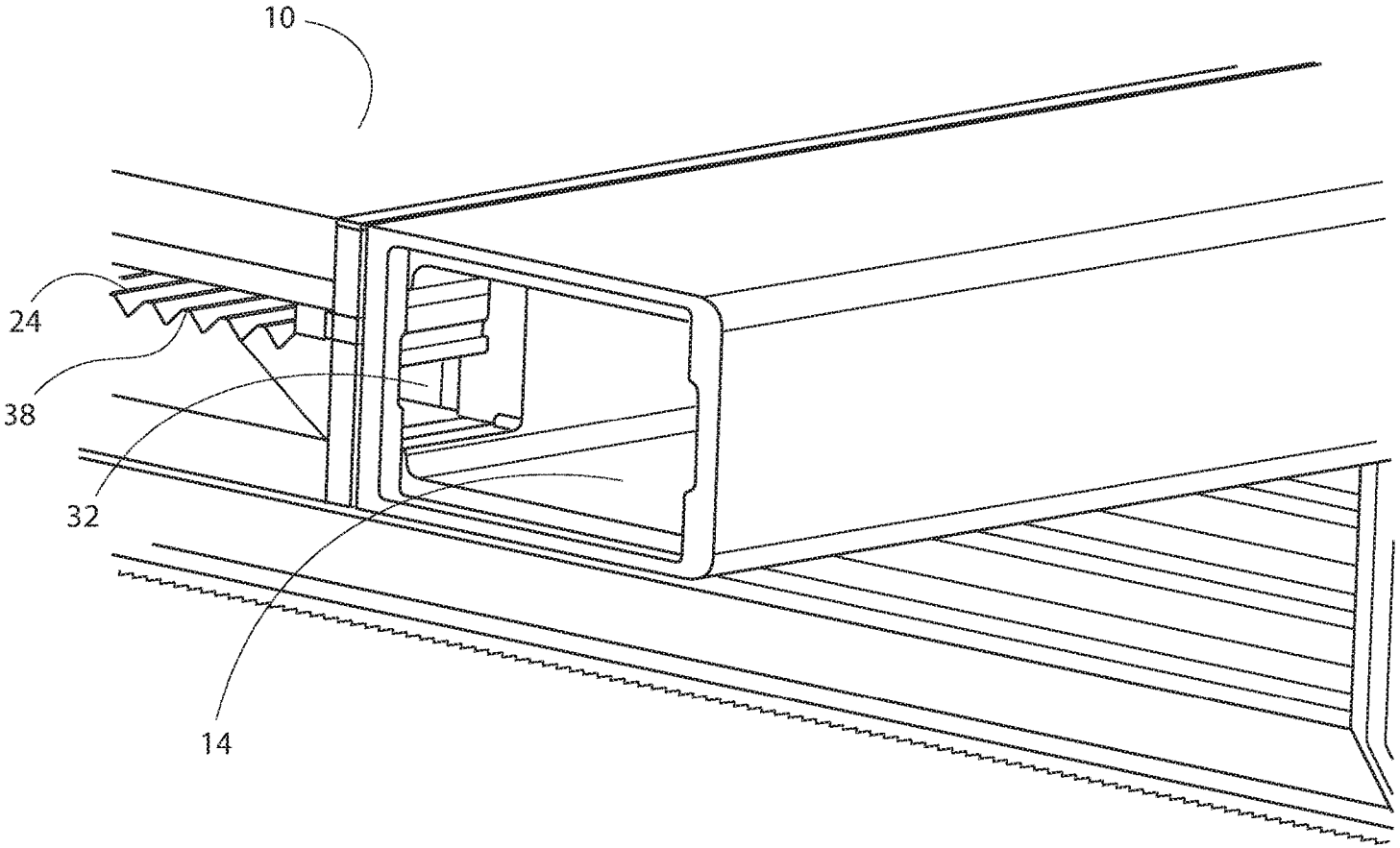
FIG. 2C is a right perspective view of the invention showing a detail of a portion of the interior of the invention.

FIG. 2A is a top left perspective view of the lighted waterfall device 10 and FIG. 2B is a left perspective cross section view of the lighted waterfall device 10 through line 2'-2' of FIG. 2A. FIG. 2C is a right perspective view of the lighted waterfall device 10 showing a detail of a portion of the interior of the lighted waterfall device 10.

Figure 3A:
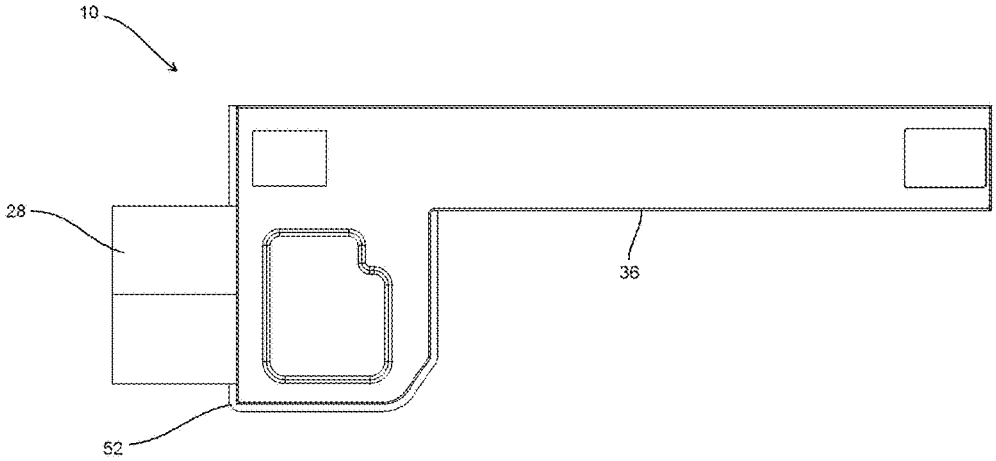
FIG. 3A is a left plan view of the invention.
Figure 3B:
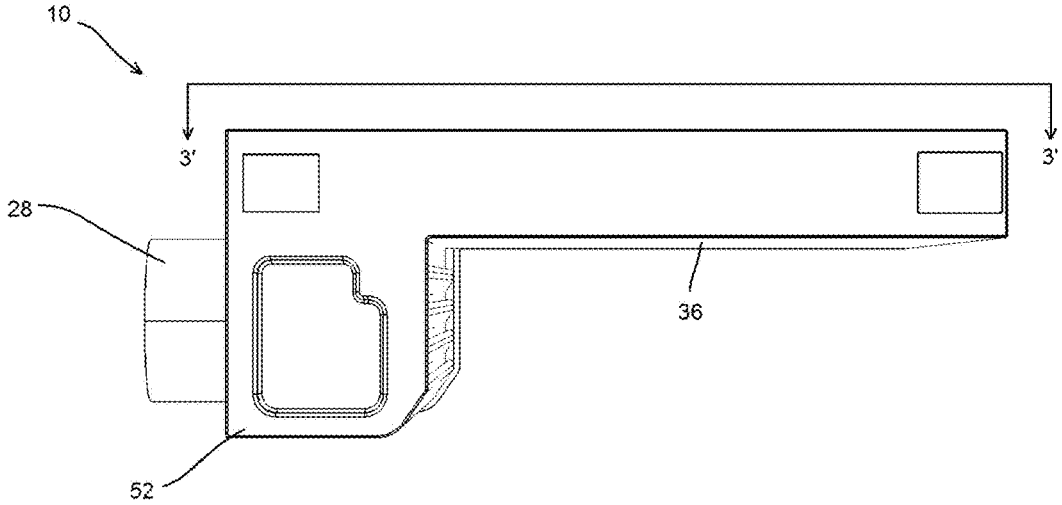
FIG. 3B is a left perspective view of the invention.
Figure 3C:
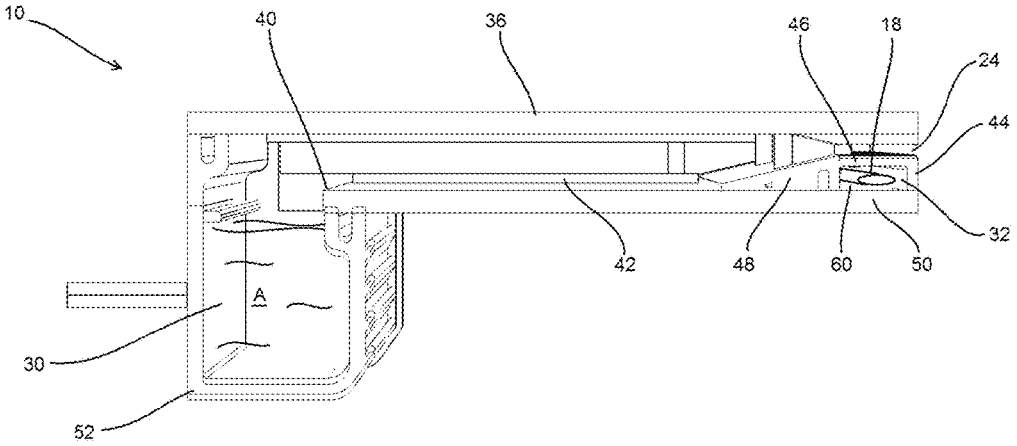
FIG. 3C is a left perspective cross section view of the invention through line 3'-3' of FIG. 3B.
Figure 4A:
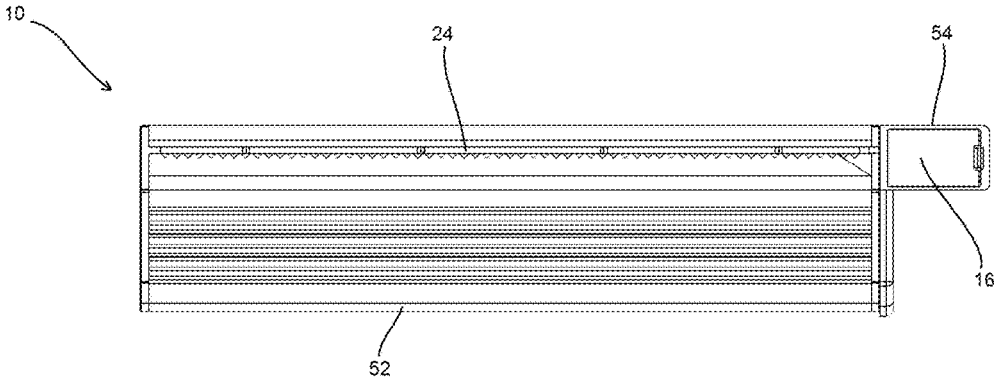
FIG. 4A is a front plan view of the invention.
Figure 4B:
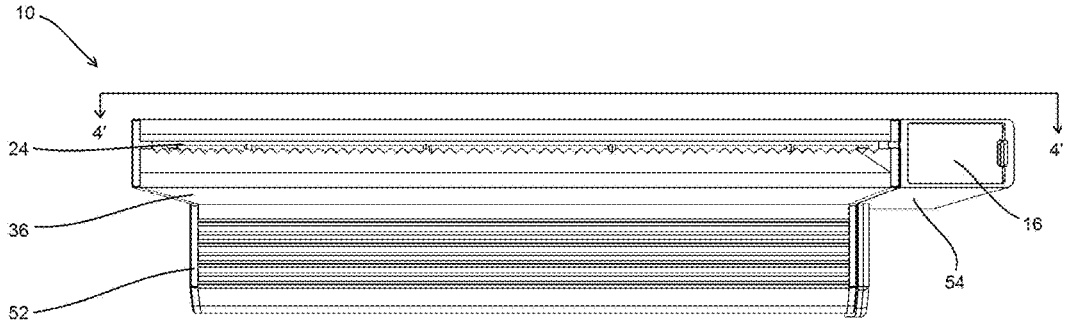
FIG. 4B is a front perspective view of the invention.
Figure 4C:
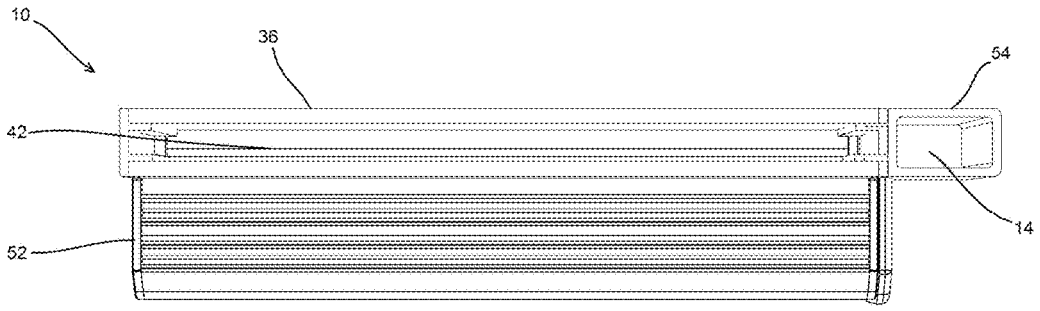
FIG. 4C is a front perspective view, partly in cross section, of the invention through line 4'-4' of FIG. 4B.
Figure 5A:
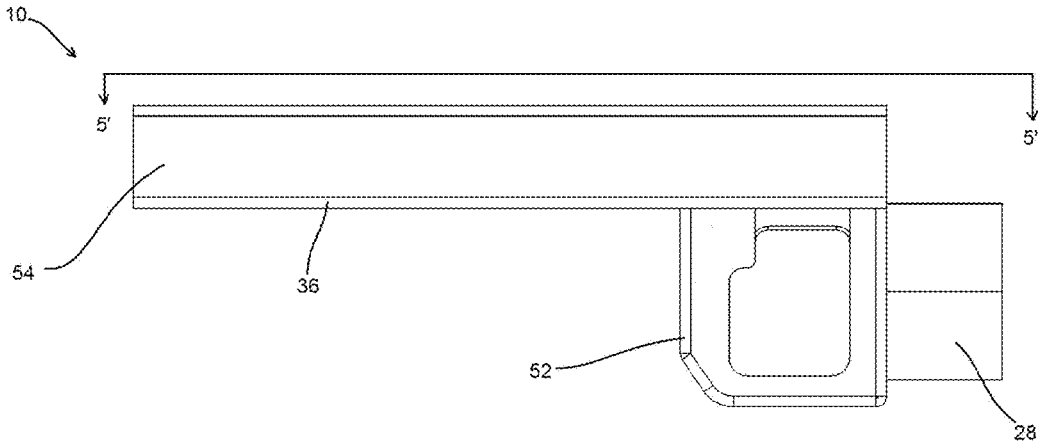
FIG. 5A is a right plan view of the invention.
Figure 5B:
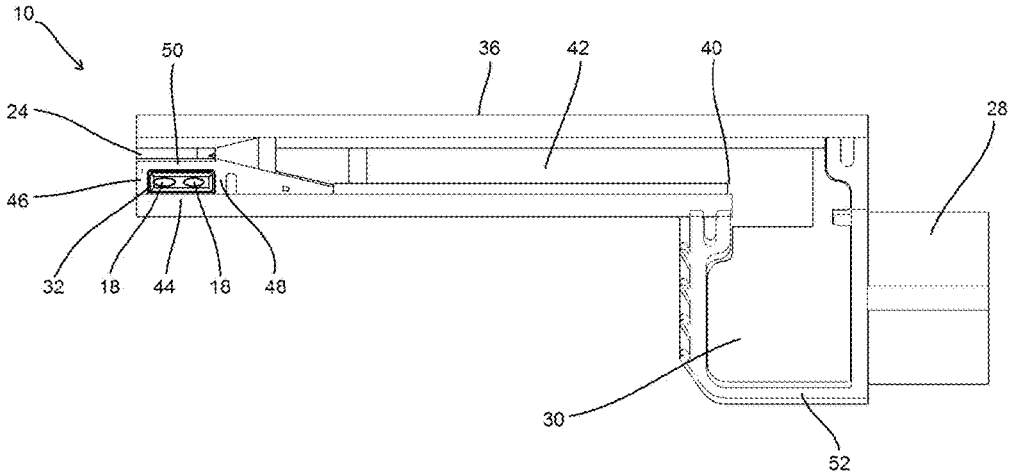
FIG. 5B is left cross section view of the invention through line 5'-5' of FIG. 5C.
Figure 5C:
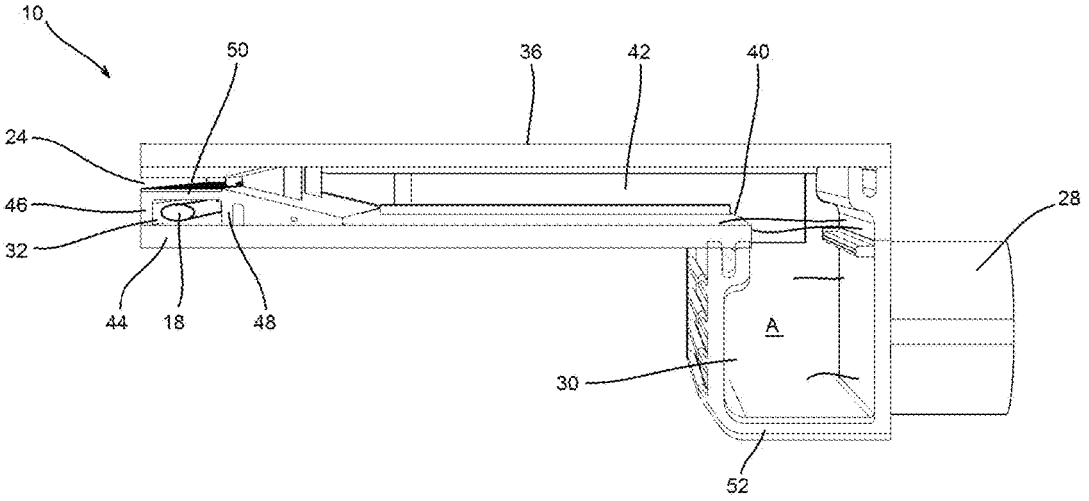
FIG. 5C is a left perspective cross section view of the invention as shown in FIG. 5B.

FIG. 3A is a left plan view and FIG. 3B is a left perspective view of the lighted waterfall device 10. FIG. 3C is a left perspective cross section view of the lighted waterfall device 10 through line 3'-3' of FIG. 3B. FIG. 4A is a front plan view and FIG. 4B is a front perspective view of the lighted waterfall device 10. FIG. 4C is a front perspective view, partly in cross section, of the lighted waterfall device 10 through line 4'-4' of FIG. 4B. FIG. 5A is a right plan view and FIG. 5B is left cross section view of the lighted waterfall device 10 through line 5'-5' of FIG. 5C. FIG. 5C is a left perspective cross section view of the lighted waterfall device 10 as shown in FIG. 5B.

Figure 6A:
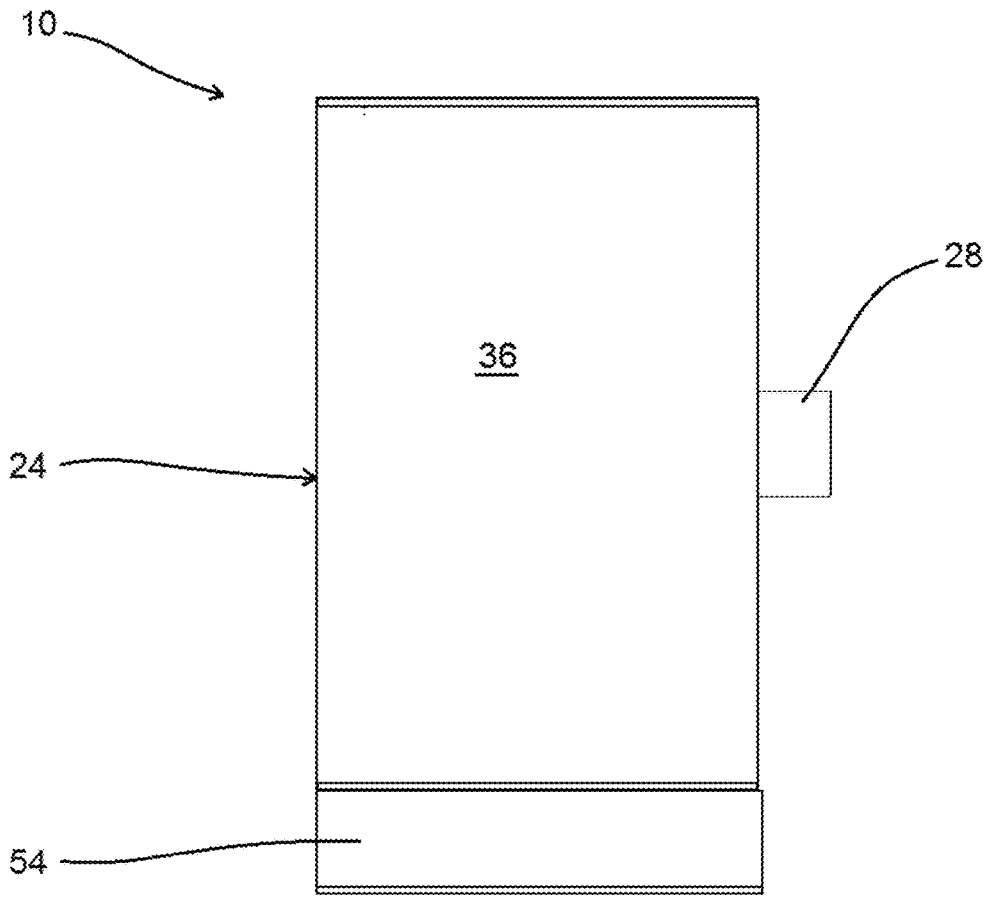
FIG. 6A is a top plan view of the invention.
Figure 6B:
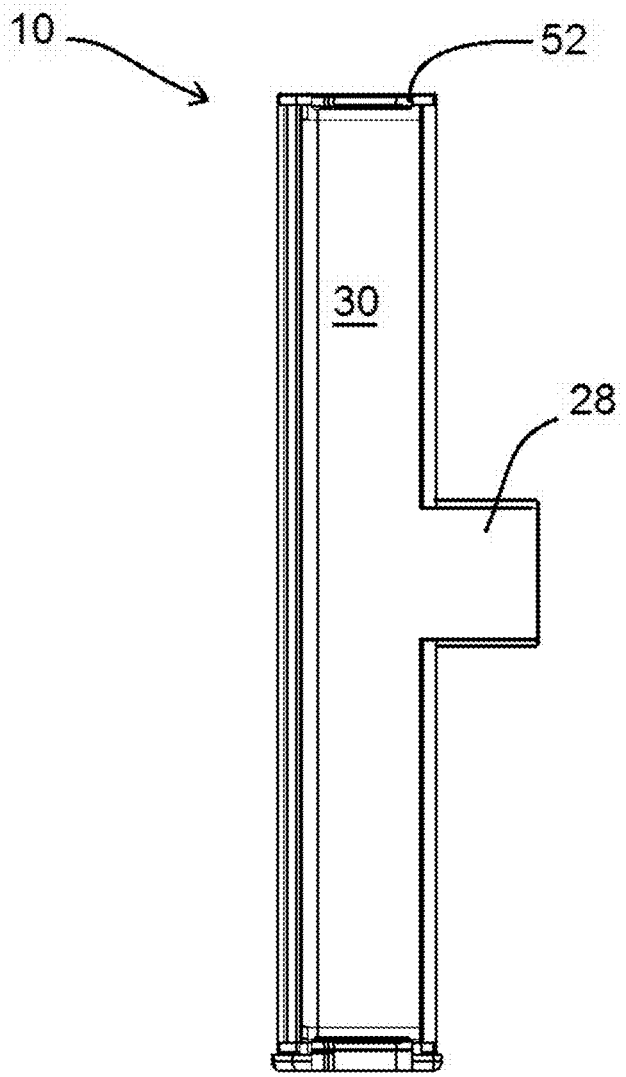
FIG. 6B is a top cross section view of the invention through line 6'-6' of FIG. 7A.
Figure 7A:
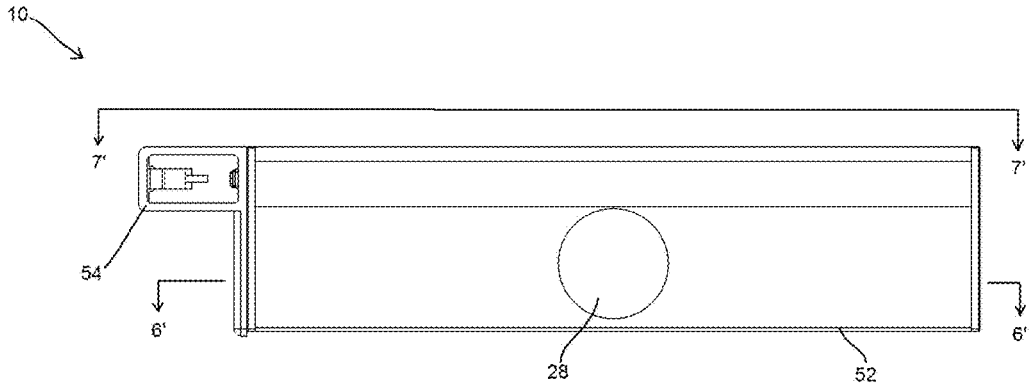
FIG. 7A is a rear plan view of the invention.
Figure 7B:
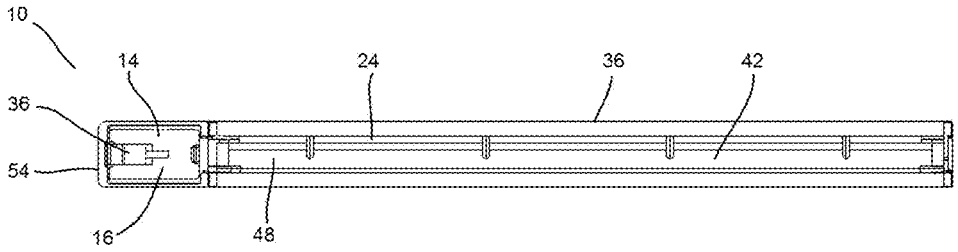
FIG. 7B is a rear cross section view of the invention through line 7'-7' of FIG. 7A.
Figure 7C:
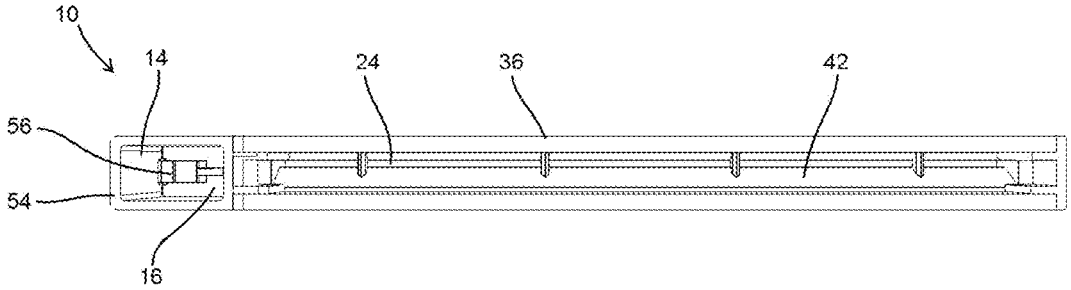
FIG. 7C is a rear perspective cross section view of the invention as shown in FIG. 7B.
Figure 8A:
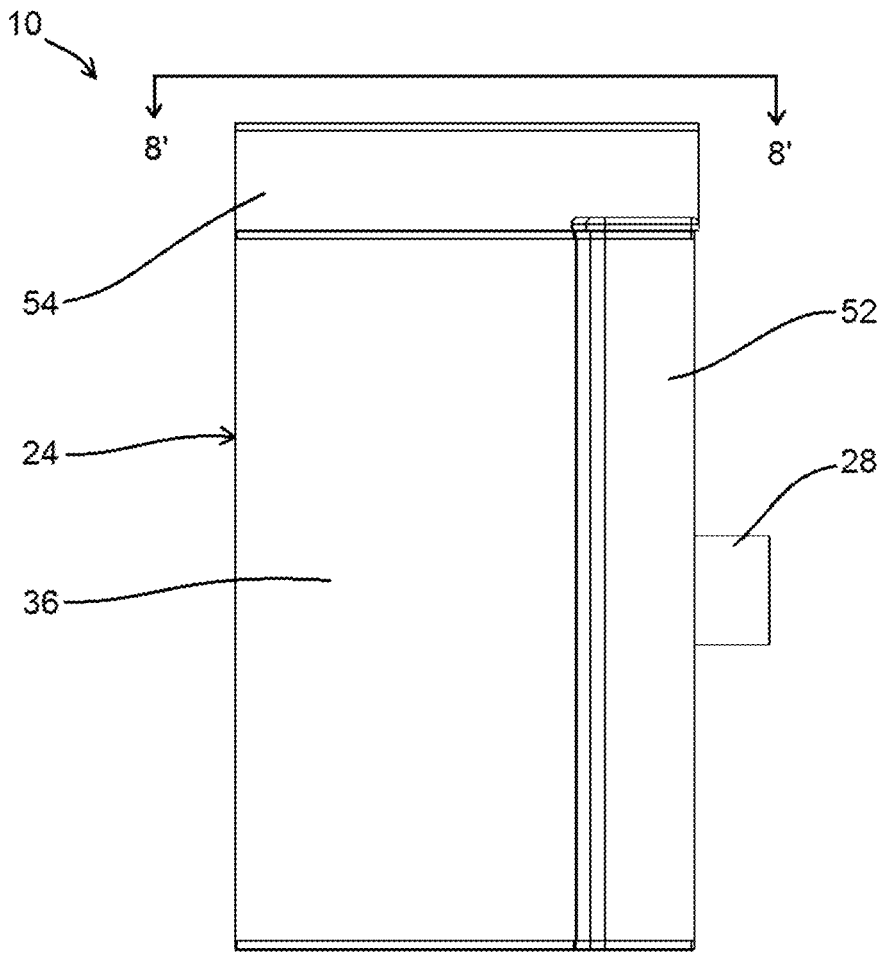
FIG. 8A is a bottom plan view of the invention.
Figure 8B:
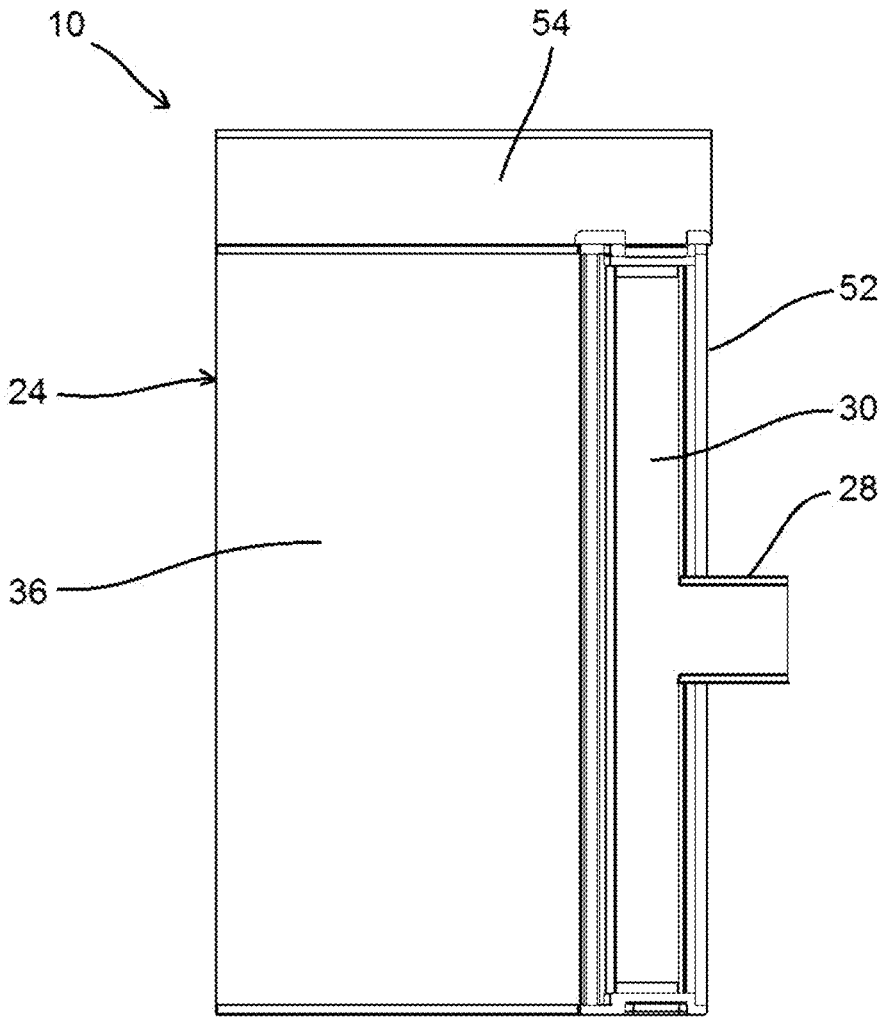
FIG. 8B is a bottom cross section view of the invention through line 8'-8' of FIG. 8A.
Figure 8C:
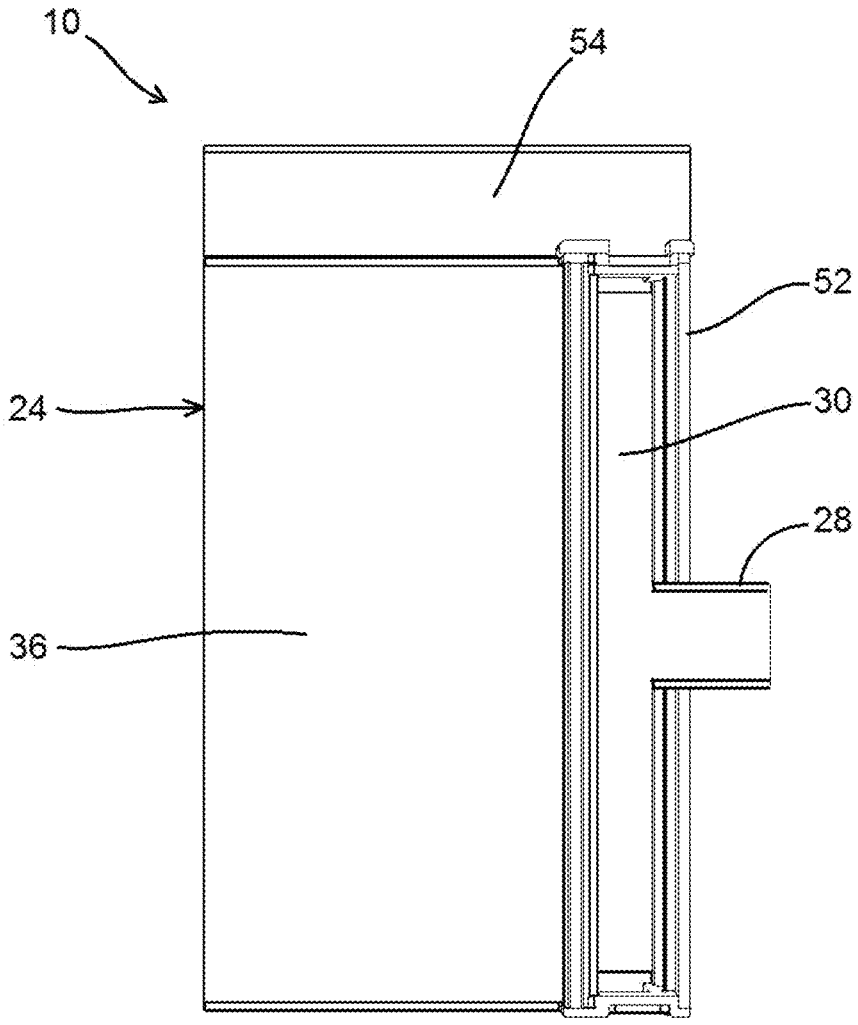
FIG. 8C is a bottom perspective cross section view of the invention as shown in FIG. 8B.

FIG. 6A is a top plan view and FIG. 6B is a top cross section view of the lighted waterfall device 10 through line 6'-6' of FIG. 7A. FIG. 7A is a rear plan view and FIG. 7B is a rear cross section view of the lighted waterfall device 10 through line 7'-7' of FIG. 6A. FIG. 7C is a rear perspective cross section view of the lighted waterfall device 10 as shown in FIG. 7B. FIG. 8A is a bottom plan view and FIG. 8B is a bottom cross section view of the lighted waterfall device 10 through line 8'-8' of FIG. 8A. FIG. 8C is a bottom perspective cross section view of the lighted waterfall device 10 as shown in FIG. 8B.

Figure 9:
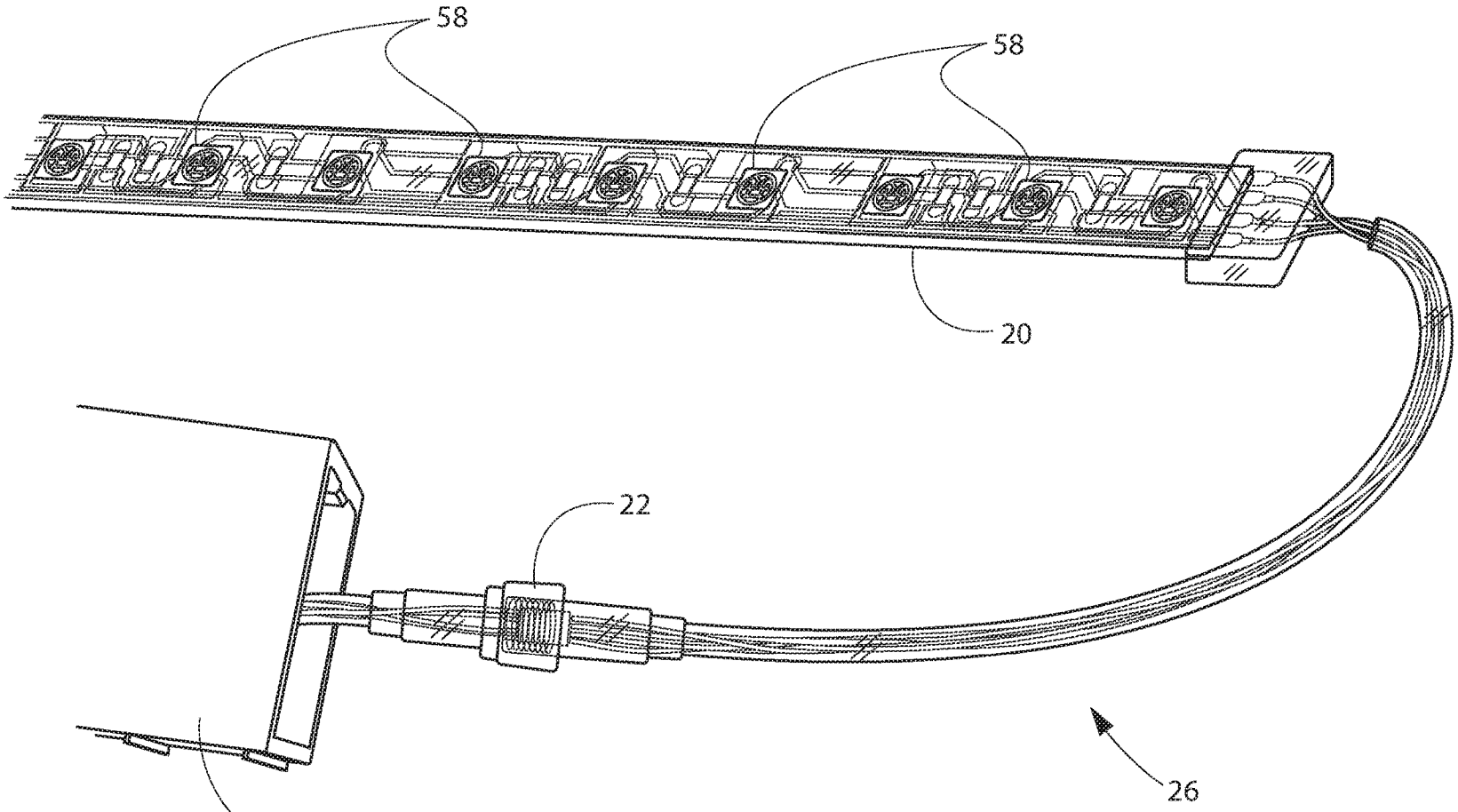
FIG. 9 is a top perspective view of a light emitting diode strip suitable for use with the invention.
Figure 10:
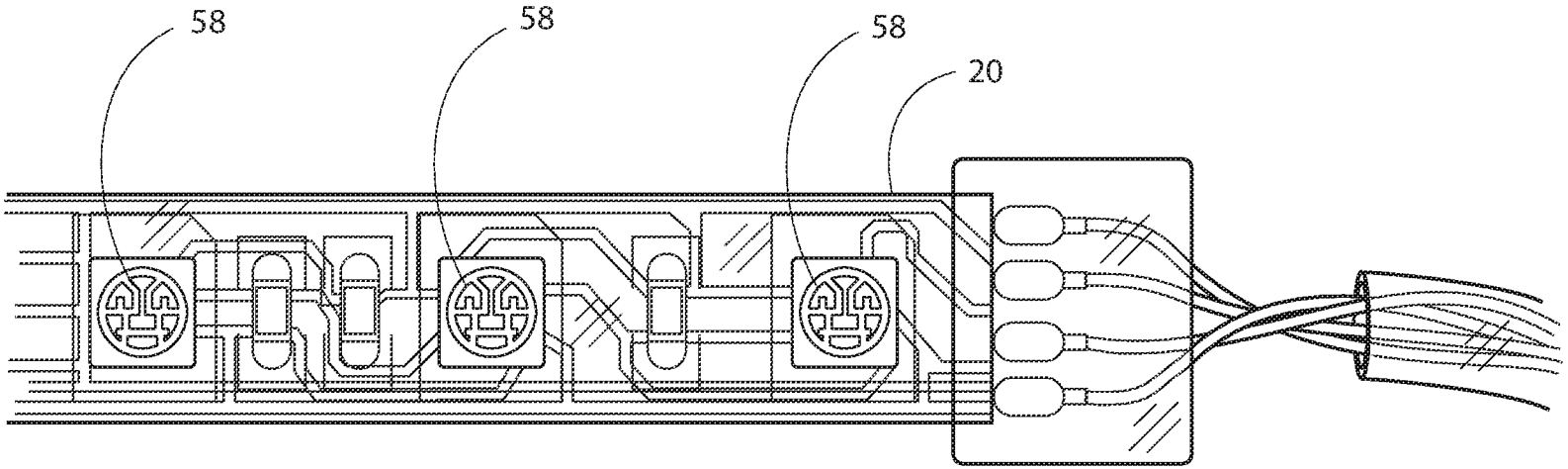
FIG. 10 is a top perspective view of a light emitting diode strip suitable for use with the invention shown in more detail.
Figure 11:
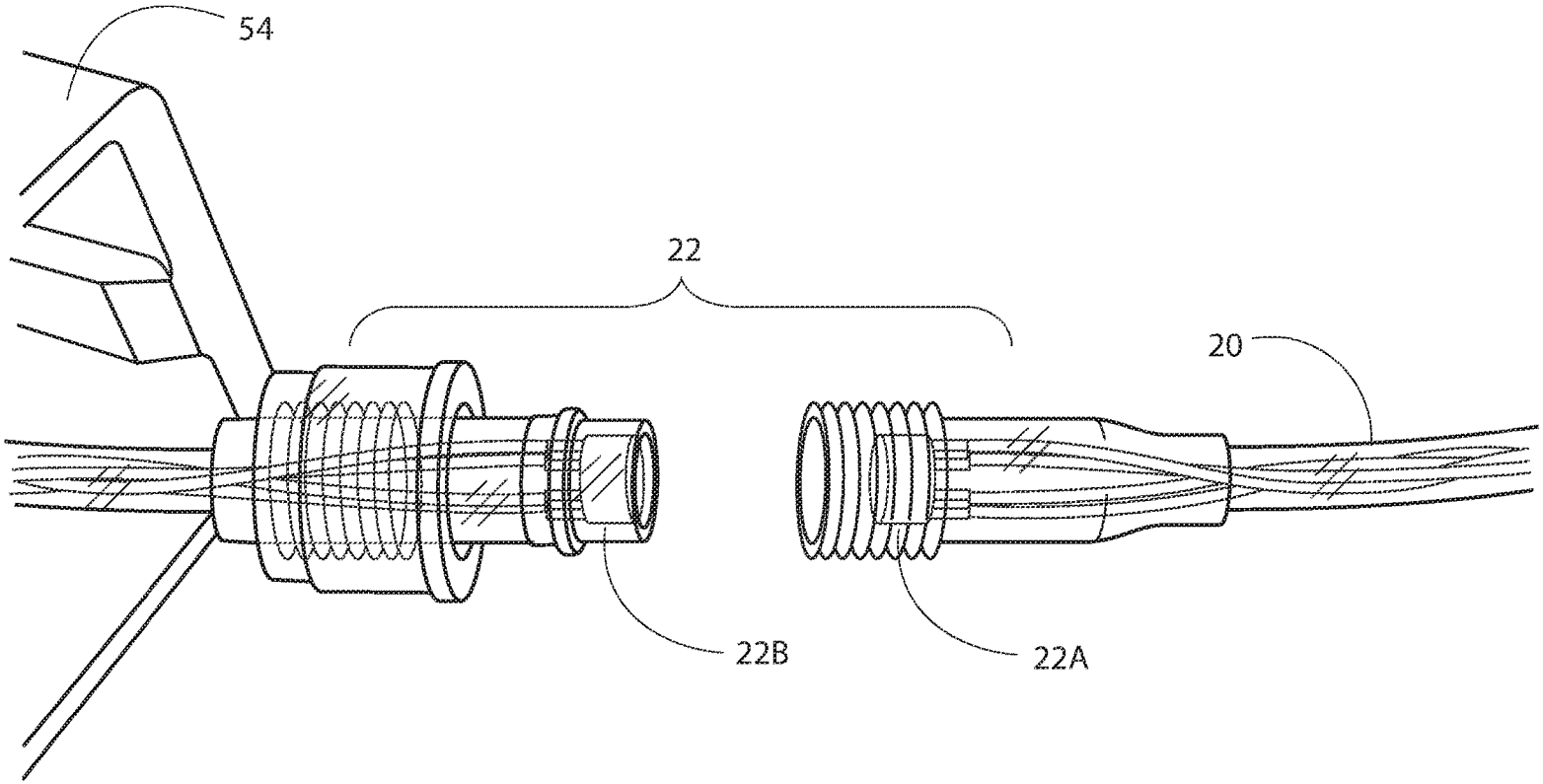
FIG. 11 is a side perspective view of a connector for electrically connecting the light emitting diode strip of FIG. 9 to the invention.

FIG. 9 is a top perspective view of a LED (light emitting diode) strip 20 suitable for use with the invention. FIG. 10 is a top perspective view of a LED strip 20 suitable for use with the invention shown in more detail. FIG. 11 is a side perspective view of a connector 22 for electrically connecting the LED strip 20 of FIG. 8 to the invention.

The lighted waterfall device produces a waterfall into a spa, swimming pool, hot tub, garden bath, or the like, together referred to herein as a spa S, and that incorporates a removable and replaceable lighting unit 26 comprising LED strip 20 and connector 22 so that, for example, the lighted waterfall device 10 can be permanently mounted yet allow the simple replacement of the lighting unit 26. Additionally, the lighted waterfall device 10 produces a lighted waterfall 12 into the spa S that provides satisfactory lighting to the water emanating from the lighted waterfall device 10. In illustrative embodiments, the lighted waterfall device 10 comprises a structure and means for maintaining the lighting unit 26 by allowing the easy and quick removal of the lighting unit 26 from the lighted waterfall device 10, and therefore from the spa S, without removing the lighted waterfall device 10 from the wall W or having to access behind the wall W.

Referring now to FIG. 1, one illustrative embodiment of a lighted waterfall device 10 representative of the present invention is a lighted waterfall device 10 that can provide an aesthetically pleasing and decorative waterfall 12 into a spa S. In this embodiment, lighted waterfall device 10 can be installed on wall W of spa S. As disclosed in more detail herein, to generate the waterfall 12, water from a water source (not shown) flows into lighted waterfall device 10 and is discharged through a primary outlet in the form of waterfall slot 24 into spa S. The water from the water source (not shown) may be a municipal water source or recirculated water from the spa S. As lighted waterfall device 10 can be placed above the surface of the water of spa S on, in, or proximal to, for example, the upper edge of wall W of spa S, lighted waterfall device 10 also can function to fill spa S with water W (i.e., in a non-recirculating mode). As shown in FIG. 1, a representative lighted waterfall device 10 can be installed on or proximal to the edge of a spa S to provide for the addition of an aesthetically pleasing and decorative waterfall 12 that flows into the spa S.

FIG. 1 also illustrates a representative placement of the port 14 and port door 16, which is a means for accessing the means for lighting 18 the waterfall 12. As disclosed in more detail herein, port door 16 can be removed from port 14 allowing access to the interior of, or an interior chamber of, lighted waterfall device 10 to access, replace, remove, or insert the means for lighting 18. Embodiments of the lighted waterfall device 10 can be placed above the surface of the water in the spa S on the upper edge of the spa wall W or within the spa wall W above the water level of the spa S so that the waterfall 12 can be a smooth flow of falling water extending from the lighted waterfall device 10 to the surface of the water in the spa s.

Referring now to FIGS. 2-5, in representative embodiments of the lighted waterfall device 10, water flows through an inlet 28 into the interior hollow or manifold 30 of the lighted waterfall device 10 and is discharged through waterfall slot 24 into the spa S. Waterfall slot 24 can have at its exit to spa S a serrated edge 38 or floor to add turbulence to the waterfall 12 and to improve the lighting effect throughout the pattern of the waterfall 12. The serrated edge 38 or floor preferably is located at a position on the waterfall device 10 proximal to or at a front end of the waterfall device 10 such that the waterfall 12 that emanates from the waterfall slot 24 flows over the serrated edge 38 or floor. When the means for lighting 18 is not on, the serrated edge 38 can provide an aesthetically pleasing pattern to an unlit waterfall 12 by adding turbulence in a controlled manner, such as by creating a pattern in the waterfall 12. Similarly, when the means for lighting 18 is on, the serrated edge 38 can provide additional aesthetic enhancement to a lit waterfall 12 by dispersing light through the water flow pattern in the waterfall 12 created by the turbulence added in a controlled manner.

A spreading area 36 can be located between and fluidly connect manifold 30 and chamber 32. Spreading are 36 can serve at least two purposes. First, spreading area 36 can allow water flowing from manifold 30 to chamber 32 to spread evenly across spreading area 36 prior to emanating from waterfall slot 24 so as to produce a more even waterfall 12. Second, spreading area 36 can provide a connection through spa wall W such that the manifold section 52 portion of the lighted waterfall device 10 can be located on one side (the "dry side") of the spa wall W and accessible from the outside of the spa S, while the waterfall slot 24 can be located on another side (the "wet side") of the spa wall W and accessible from the inside of the spa S.

A means for lighting 18 (see FIGS. 9-11) the waterfall 12, and more particularly for lighting the water emanating from the lighted waterfall device 10, is contained within a chamber 32 in the lighted waterfall device 10 proximal to the waterfall slot 24. Additionally, a port 14 for accessing the means for lighting 18 is located at, on, or proximal to the front of the lighted waterfall device 10 structure, preferably proximal to the waterfall slot 24, so as to allow easier access to the means for lighting 24 located within chamber 32. The port cover 16 can be a door or other covering to chamber 32 in which the means for lighting 18 is retained. The chamber 32 can have a transparent, semi-transparent, or translucent divider between the chamber 32 and the waterfall slot 24 so as to allow the means for lighting 18 to light the waterfall 12 emanating from the waterfall slot 24 yet be separated from the waterfall 12 in a "dry" zone.

Referring now to FIG. 2A, a general configuration of an illustrative embodiment of the lighted waterfall device 10 is shown. Outlet 28 is on the rear of the lighted waterfall device 10 and waterfall slot 24 is on the front of the lighted waterfall device 10. At least a portion of spreading area 36 is located within spa wall W. Port 14 and port cover 16 are located to a side of waterfall slot 24, also on the front of the lighted waterfall device 10.

Referring now to FIG. 2B, the interior of a lighted waterfall device 10 is shown. Inlet 28 allows water to enter manifold 30 and to fill manifold. Optional baffles 34 can reduce turbulence in the water entering manifold 30 and trap debris for later removal. Once water in manifold 30 rises to the level of lip 40, water is generally evenly spread throughout manifold 30 and generally evenly flows over lip 40 into the interior of spreading area 36. Spreading area 36 comprises a passage 42 leading from manifold 30 to waterfall slot 24, the passage 42 being about the same as or greater than the height of waterfall slot 24, about the same as the width of waterfall slot 24, and about the same length as spreading area 36 such that water flowing from manifold 30 evenly flows through passage 42 to waterfall sot 24 and evenly flows out of waterfall slot 24 to form waterfall 12.

FIG. 2B also shows a preferred location of chamber 32, namely beneath waterfall slot 24. Chamber 32 is an elongated hollow chamber running about the entire width and at least a portion of the depth of waterfall slot 24. In this specification, the width of waterfall slot 24 is the dimension of waterfall slot 24 extending across the front of the lighted waterfall device 10, and the depth of waterfall slot 24 is the dimension of waterfall slot 24 extending from the front of lighted waterfall device 10 towards the back of lighted waterfall device 10. Chamber 32 is separated from the ambient in front of lighted waterfall device 10 by a front wall 44, is separated from waterfall slot 24 by a top wall 46, and is separated from passage 42 by a rear wall 48. Chamber 32 also has a bottom wall 50. Preferably, at least top wall 46 is made of a clear, transparent, translucent, or semi-transparent material such that light from the means for lighting 18 can travel through top wall 46 into water flowing through waterfall slot 24. Front wall 44 also may be made of a clear, transparent, translucent, or semi-transparent material such that light from the means for lighting 18 can affect waterfall 12 after emanating from waterfall slot 24. On one end, chamber 32 cooperates with port 14 so as to allow access to chamber 32 from port 14 (see FIG. 2C).

Referring now to FIG. 2C, a detail of a portion of the interior of the lighted waterfall device 10 illustrating the cooperation between chamber 32 and port 14 is shown. As can be seen, port 14 is an opening through the front of lighted waterfall device 10 allowing access to a portion of the interior of lighted waterfall device 10 including access to chamber 32. Through port 14, a means for lighting 18 can be inserted into or removed from chamber 32. A port cover 16 can be used to cover and close port 14.

Referring now to FIG. 3A, a general front structure is shown for a preferred embodiment of lighted waterfall device 10. Inlet 28, attached to the rear of lighted waterfall device 10, allows water to flow into the interior of the lighted waterfall device 10, namely, into manifold 30 located within manifold section 52. Extending frontwards from the manifold section is spreading area 36. Spreading area 36 terminates at the front of the lighted waterfall device, where waterfall slot 24 is located.

Referring now to FIG. 3B, another detail similar to FIG. 3A is shown, this time in perspective Referring now to FIG. 3C, a detail of a portion of the interior of the lighted waterfall device 10 is shown. Water A fills a portion of manifold 30. Once water in manifold 30 rises to the level of lip 40, water A flows over lip 40 and into the passage 42 in the interior of spreading area 36. Water A flows through passage 42 from manifold 30 to waterfall slot 24, and then flows out of waterfall slot 24 to form waterfall 12. As disclosed in more detail herein, light emanating from means for lighting 18 within chamber 32 illuminates water A as water A passes over top wall 46 (which also can be considered a bottom wall of waterfall slot 24), thus providing illumination to waterfall 12. In addition, at least some of the internal surfaces of chamber 32 can be coated with a reflective material 60 to increase the amount of light directed to waterfall 12. In this view, bottom wall 50 is coated with a reflective material 60 to help direct light up through top wall 46 or front wall 44, whichever or both are transparent, semi-transparent, or translucent, and into water or waterfall 12.

Referring now to FIG. 4A, a general left side structure is shown for a preferred embodiment of lighted waterfall device 10. Waterfall slot 24 extends generally the entire width of the lighted waterfall device 10, with the exception of the thickness of structure walls and of the port section 54. Manifold section 52 extends downward and port section 54 extends sidewards from the lighted waterfall device 10. Port cover 16 is shown covering port 14.

Referring now to FIG. 4B, a front perspective view of the lighted waterfall device 10 is shown for more detail of the structure. Waterfall slot 24 extends generally the entire width of the lighted waterfall device 10, with the exception of the thickness of structure walls and of the port section 54. Manifold section 52 extends downward from the rear of spreading area 36, and port section 54 extends sidewards from the front of, or just in front of, the side of spreading area 36. Port cover 16 is shown covering port 14.

Referring now to FIG. 4C, a detail of a portion of the interior of the lighted waterfall device 10 is shown. In this view, the interior of passage 42 and of port 14 is shown. Passage 42 provides for the generally free flow of water from manifold 30 through spreading area 36 to waterfall slot 24. Port 14 allows access to chamber 32.

Referring now to FIG. 5A, a general right side structure is shown for a preferred embodiment of lighted waterfall device 10. Inlet 28 extends rearward from the back of manifold section 52. Spreading area 36 extends frontward from the top of manifold section 52. Port section 54 extends sideward from the front of or just in front of spreading area.

Referring now to FIG. 5B, a detail of a portion of the interior of the lighted waterfall device 10 is shown. Water A fills a portion of manifold 30 over the level of lip 40, and begins to flow into the passage 42 in the interior of spreading area 36. Water A then will flow through passage 42 from manifold 30 to waterfall slot 24, and then flow out of waterfall slot 24 to form waterfall 12. As disclosed in more detail herein, light emanating from means for lighting 18 within chamber 32 illuminates water A as water A passes over top wall 46 (which also can be considered a bottom wall of waterfall slot 24), thus providing illumination to waterfall 12. In this view, two means for lighting 18 are shown in chamber 32. For example, a first means for lighting 18 can produce a steady light or a light of a first color, while a second means for lighting 18 can produce a blinking or pulsing light or a light of a second color. Chamber 32 can be structured to hold one, two, or more means for lighting.

Referring now to FIG. 5C, another detail similar to FIG. 5B of a portion of the interior of the lighted waterfall device 10 is shown, this time in perspective.

Referring now to FIG. 6A, a general top structure is shown for a preferred embodiment of lighted waterfall device 10. In this view, inlet 28 can be extending from the rear of lighted waterfall device 10, and port section 54 can be seen extending from a side of lighted waterfall device 10. Waterfall slot 24 is located on the front of lighted waterfall device 10. Although spreading area 36, and therefore a large section of lighted waterfall device 10, is shown as generally rectangular in cross section, this shape is illustrative only. Other shapes, such as squares, ovals, trapezoids, and other geometric shapes can be suitable depending on the aesthetics desired or the shape and structure of the spa S or the spa wall W.

Referring now to FIG. 6B, a detail of a portion of the interior of the lighted waterfall device 10 is shown, specifically showing the interior of manifold 30 and inlet 28. As can be seen, inlet 28 leads to and is fluidly connected to manifold 30 such that water can flow directly from a water source through inlet 28 to manifold 30.

Referring now to FIG. 7A, a general rear structure is shown for a preferred embodiment of lighted waterfall device 10. In this view, inlet 28 can be extending from the rear of lighted waterfall device 10, specifically from the rear of manifold section 52, and port section 54 can be seen extending from a side of lighted waterfall device 10. Although manifold section 52, and therefore a large section of lighted waterfall device 10, is shown as generally rectangular in cross section, this shape is illustrative only. Other shapes, such as squares, ovals, trapezoids, and other geometric shapes can be suitable depending on the aesthetics desired or the shape and structure of the spa S or the spa wall W.

Referring now to FIG. 7B, a detail of a portion of the interior of the lighted waterfall device 10 is shown, specifically the interior of spreading area 36, namely, passage 42. In this view, which is from the rear of the lighted waterfall device 10 looking through passage 42 and out through waterfall slot 24, the narrowing of passage 42 caused by rear wall 48 of chamber 32 can be seen. This gives rise to a waterfall slot 24 that is narrower, that is, has a smaller height, that the height of passage 42. The rise in passage 42 due to the presence of rear wall 48 also helps to create a more uniform waterfall 12 as water can build up evenly behind and along rear 48 wall and therefore overflow rear wall 48 more evenly prior to flowing through waterfall slot 24. In other embodiments, waterfall slot 24 can be the same height as or have a larger height than the height of passage 42. Port cover 16 can be seen in port section 54, in this view comprising a latch 56 for securing port cover closed across the front opening of port 14.

Referring now to FIG. 7C, another detail similar to FIG. 7B of a portion of the interior of the lighted waterfall device 10 is shown, this time in perspective.

Referring now to FIG. 8A, a general bottom structure is shown for a preferred embodiment of lighted waterfall device 10. In this view, inlet 28 can be extending from the rear of lighted waterfall device 10, specifically from the rear of manifold section 52, and port section 54 can be seen extending from a side of lighted waterfall device 10, specifically from a side of spreading section 36. Waterfall slot 24 is located on the front of lighted waterfall device 10.

Referring now to FIG. 8B, a detail of a portion of the interior of the lighted waterfall device 10 is shown, specifically showing the interior of manifold 30 and inlet 28. As can be seen, inlet 28 leads to and is fluidly connected to manifold 30 such that water can flow directly from a water source through inlet 28 to manifold 30.

Referring now to FIG. 8C, another detail similar to FIG. 8B of a portion of the interior of the lighted waterfall device 10 is shown, this time in perspective.

Referring now to FIGS. 9-11, in one embodiment, the means for lighting 18 is a LED strip 20 of light emitting diodes (LEDs). LED strip 20 can comprise at least one and preferably a plurality of individual LEDs 58 so as to provide more uniform light across the waterfall 12. By using an LED strip 20, the LED strip 20 can be selected or cut to be of a desired length, such as the length of the chamber 32. In this manner, different lengths LED strips 20 can be used for different sized lighted waterfall devices 10.

Referring now to FIG. 9, a representative LED strip 20 is shown comprising a plurality of LEDs 58. At one end of LED strip 20 is a connector 22 for connecting the LED strip 20 to an electrical source for powering the LEDs 58. The connector 22 is convenient in that it allows the LED strip 20 to be connected to and disconnected from the lighted waterfall device 10 for ease of removal and replacement. If a user needs to replace a defective LED strip 20 with a new LED strip 20, or to replace a LED strip 20 of one color of LEDs 58 for a LED strip 20 of another color of LEDs 58, all the user needs to do is to disconnect the connector 22, remove the first LED strip 20, insert the new LED strip 20, and connect the connector 22.

Referring now to FIG. 10, an enlarged view of LED strip 20 is shown for additional detail.

Referring now to FIG. 11, an enlarged view of a representative connector 22 is shown, with strip connector 22A being part of the LED strip 20 and device connector 22B being attached to the lighted waterfall device 10.

Preferably, chamber 32 is segregated from the remainder of the interior of the lighted waterfall device 10 such that the interior of chamber 32 remains dry. Although this is not a requirement as there are waterproof LED strips 20 and waterproof connectors 22, it is more convenient as both waterproof and non-waterproof LED strips 20 and connectors 22 can be used.

Thus, a representative lighted waterfall device 10 of the present invention generally comprises an inlet 28, a primary outlet or waterfall slot 24, an interior manifold 30 for holding and spreading water along the waterfall slot 24, a chamber 32 for the means for lighting 18 the waterfall 12, and an access port 14 to the chamber 32. When the lighted waterfall device 10 is installed in the spa S, the lighted waterfall device 10 can appear as a generally continuous shaped structure with the waterfall slot 24 generally in the center of the lighted waterfall device 10 such that water emanates from the lighted waterfall device 10 into the spa S. When the means for lighting 18 is on, light is directed to and lights the waterfall 12 emanating from the waterfall slot 24.

Lighted waterfall device 10 provides an aesthetically pleasant waterfall 12 into spa S. As lighted waterfall device 10 preferably is located above the water surface of spa S on, for example, wall W of spa S, waterfall 12 can provide a smooth flow of falling water extending from lighted waterfall device 10 to the water surface of spa S. For aesthetic reasons waterfall 12 can be substantially smooth over its width and over its length as it flows into the water of spa S. More particularly, waterfall 12 from lighted waterfall device 10 preferably is free of bubbles and ripples and flows as a generally continuous sheet of water. The preferred structure of the lighted waterfall device 10 helps accomplish this by having a manifold 30 and a rear wall 48 interrupting passage 42, both of serve to even the flow of water through and over waterfall slot 24.

The lighted waterfall device 10 can be anchored to or contained within the wall W or edge of a spa S using any appropriate means as long as water is fed into, and water can flow out of, the lighted waterfall device. In one embodiment, the waterfall apparatus may be contained within the spa wall W, such as within a concrete or stone spa wall W. In this embodiment, the waterfall sot 24 would face the interior of the spa (the "wet side") and the inlet 28 could face in a generally opposite direction towards the mechanical components of the spa (the "dry side"). This can be considered a more permanent installation of the lighted waterfall device 10. In another embodiment, the lighted waterfall device 10 may be structured to have securing ends for securing the lighted waterfall device to the spa wall W. In this embodiment, the lighted waterfall device 10 can be installed with a minimum of disturbance to the surrounding spa S. This can be considered a less permanent installation of the lighted waterfall device 10. In any type of installation, it is preferable to have the port 14 facing into the spa S, or at least accessible from the spa S, so as to take advantage of the port 14 and the simple and convenient insertion and removal of the means for lighting 18.

The lighted waterfall device 10 can be used on almost any artificial water body. While the lighted waterfall device 10 is described in connection with a spa S, it is understood that the lighted waterfall device 10 can be used on spas, swimming pools, tubs, and the like. For example, the lighted waterfall device 10 can be placed on or proximal to the edge of a swimming pool so to provide a waterfall 12. One of ordinary skill in the art can modify the lighted waterfall device 10 without undue experimentation so that it can be placed on almost any artificial water body.

As prior art waterfall apparatuses typically are unitary devices with the individual parts having been glued, welded or otherwise adhered together, access to the interior of such prior art waterfall apparatuses often is impossible or at least very difficult. Therefore, the removable port cover 16 and the convenient placement of port 14 in an easy to reach location on the front of the lighted waterfall device 10 of the present invention allows for access to, insertion of, removal of, and replacement of the means for lighting 18, such as LED strip 20, that otherwise may not be possible in prior art waterfall apparatuses. For example, the means for lighting in prior art waterfall apparatuses may be permanently anchored in such devices, and inaccessible to a user. If the means for lighting in prior art waterfall apparatuses fail, or a user desires to change the means for lighting in prior art waterfall apparatuses, it may be impossible to remove or replace the means for lighting without significant deconstruction or destruction of the prior art waterfall apparatus or the spa.

In use, the means for lighting 18 can be inserted into and removed from the chamber 32 via the port 14. Specifically, a user can remove the port cover 16 to access the port 14. The means for lighting 18 is readily accessible through the port 14, and the user can grasp the mean for lighting 18, pull the means for lighting 18 out of the chamber 32, and disconnect the means for lighting via connector 20. The user then can insert a new or different means for lighting in the chamber 32 via the port 14, connect the connector 20, and close the port 14 using the port cover 16. In this manner, if the means for lighting 18 fails, the means for lighting 18 can be easily replaced without disassembling the lighted waterfall device 10, the spa S, or the spa wall W. Additionally, if a user decides to change the color of the means for lighting 18, a means for lighting 18 of one color can be easily replaced with a means for lighting 18 of another color without disassembling the lighted waterfall device 10, the spa S or the spa wall W. LED strips 20 of various lengths can be inserted into the chamber 32, irrespective of the length of the chamber 32. For example, if a user desires to illuminate only a portion of a waterfall 12, the user can insert a LED strip 20 of a length shorter than the chamber 32, and thus shorter than the waterfall slot 24.

The shape of waterfall 12 can be modified by the configuration of waterfall slot 24. For example, if waterfall slot 24 is a regular uninterrupted slit, a relatively smooth waterfall 12 over its length and width can be generated. Alternatively, if divisions or interruptions are introduced into the waterfall slot 24, or waterfall slot 24 has a non-linear shape, waterfall 12 can have a sprinkler type shape or a scalloped shape, which is not a smooth shaped waterfall. One of ordinary skill in the art can modify waterfall slot 24 so that lighted waterfall device 10 will produce a waterfall 12 of a desired shape. The shape of chamber 32 preferably is structured to parallel or mirror the shape of the waterfall slot 24 to provide a satisfactory amount of illumination to the waterfall 12.

With regard to allowing the light from the means for lighting 18 to act upon the water and the waterfall 12, as disclosed herein, at least top wall 46 and/or front wall 44, or any other wall between means for lighting 18 and water flowing through waterfall slot 24 or waterfall 12, preferably is transparent, semi-transparent, translucent, or conducts light in some manner to water flowing through waterfall slot 24 or waterfall 12.

As aesthetic alternatives, chamber 32 can be structured to hold at least two means for lighting 18, such as at least two LED strips 20 to generate an illuminated waterfall 12 of more than one color or more than one pattern of light. For example, a first LED strip can produce a steady light or a light of a first color, while a second LED strip 20 can produce a blinking or pulsing light or a light of a second color. Alternatively or in addition, at least some of the internal surfaces of chamber 32 can be coated with a reflective material to increase the amount of light directed to waterfall 20.

Lighted waterfall device 10 can be manufactured from relatively inexpensive materials. For example, lighted waterfall device 10 can be formed of plastics, metal, or other materials. Preferably, lighted waterfall device 10 can be formed from molded or forged parts made from a plastic material as such material will not rust from the exposure to water, particularly chlorinated water. Such plastics, metals, and other materials are known in the art. Alternatively, for more elegant or expensive installations, at least portions of lighted waterfall device 10 can be made of more elegant or expensive materials, such as gold, silver, pewter, crystal, and the like.

The foregoing detailed description of the preferred embodiments and the appended figures have been presented only for illustrative and descriptive purposes and are not intended to be exhaustive or to limit the scope and spirit of the invention. The embodiments were selected and described to best explain the principles of the invention and its practical applications. One of ordinary skill in the art will recognize that many variations can be made to the invention disclosed in this specification without departing from the scope and spirit of the invention.

LIST OF REFERENCE NUMERALS

10 lighted waterfall device
12 waterfall
14 port
16 port cover
18 means for lighting
20 LED strip
22 connector
24 waterfall slot
26 lighting unit
28 inlet
30 manifold
32 chamber
34 baffles
36 spreading area
38 serrated edge
40 lip
42 passage
44 front wall
46 top wall

48 rear wall
50 bottom wall
52 manifold section
54 port section
56 latch
58 LED
60 reflective material

What is claimed is:

1. A waterfall apparatus for producing an artificial waterfall comprising:

a) a waterfall outlet for producing a waterfall, the waterfall outlet being on a front end of the waterfall apparatus, the waterfall outlet terminating in a horizontal waterfall slot through which water emanates from the waterfall apparatus, the waterfall slot also being on the front end of the waterfall apparatus and having a horizontal width relative to the front end;

b) a lighting unit;

c) a chamber for containing the lighting unit, wherein the chamber is located immediately below the waterfall slot, the chamber having a horizontal width also relative to the front and that is substantially the same as the waterfall slot width and wherein the chamber has at least one side located between the chamber and the waterfall slot that is a material that allows light from the lighting unit to act upon the waterfall by lighting at least one of water flowing through the waterfall slot and water emanating from the waterfall slot; and d) a port to the chamber for accessing the lighting unit, wherein the port is located through and accessible from the front end of the waterfall apparatus, and wherein the port is separate from the waterfall slot whereby the chamber is not in fluid communication with the waterfall outlet and the waterfall slot.

2. The waterfall apparatus as claimed in claim 1, wherein the at least one side of the chamber is a material selected from the group consisting of clear, transparent, translucent, and semi-transparent materials.

3. The waterfall apparatus as claimed in claim 2, wherein the waterfall slot and the chamber are located at a position on the front end of the waterfall apparatus such that the waterfall that emanates through the waterfall slot, out of the waterfall outlet, falls directly into a spa tub.

4. The waterfall apparatus as claimed in claim 2, wherein the lighting unit has a length that is substantially the same length as the chamber length.

5. The waterfall apparatus as claimed in claim 4, wherein the lighting unit has a connector that cooperates with a connector on the waterfall apparatus whereby the lighting unit can be connected to and disconnected from the connector on the waterfall apparatus for removing the lighting unit from the waterfall apparatus and installing a different lighting unit into the waterfall apparatus.

6. The waterfall apparatus as claimed in claim 5, wherein the lighting strip and the connector is accessible through the port.

7. The waterfall apparatus as claimed in claim 4, wherein the lighting unit is a strip of light emitting diodes.

8. The waterfall apparatus as claimed in claim 1, wherein the waterfall outlet comprises a serrated edge or floor located at a position on the waterfall apparatus proximal to or at the waterfall slot at the front end of the waterfall apparatus such that the waterfall that emanates out of the waterfall slot flows over the serrated edge, wherein the serrated edge adds turbulence to the waterfall in a controlled manner to create a waterfall flow pattern, whereby light is dispersed through the waterfall flow pattern.

9. The waterfall apparatus as claimed in claim 3, wherein the waterfall outlet comprises a serrated edge or floor located at a position on the waterfall apparatus proximal to or at the waterfall slot at the front end of the waterfall apparatus such that the waterfall that emanates out of the waterfall slot flows over the serrated edge, wherein the serrated edge adds turbulence to the waterfall in a controlled manner to create a waterfall flow pattern, whereby light is dispersed through the waterfall flow pattern.

10. A waterfall apparatus for producing an artificial waterfall comprising:

a) a waterfall outlet for producing a waterfall, the waterfall outlet being on a front end of the waterfall apparatus, the waterfall outlet terminating in a horizontal waterfall slot through which water emanates from the waterfall apparatus, the waterfall slot also being on the front end of the waterfall apparatus and having a horizontal width relative to the front end;

b) a lighting unit;

c) a chamber for containing the lighting unit, wherein the chamber is not in fluid communication with the waterfall outlet and the waterfall slot, wherein the chamber is located immediately below the waterfall and the waterfall slot, the chamber having a horizontal width also relative to the front and that is substantially the same as the waterfall slot width, wherein the chamber has at least one side located between the chamber and the waterfall slot that is a material that allows light from the lighting unit to act upon the waterfall by lighting at least one of water flowing through the waterfall slot and water emanating from the waterfall slot, and wherein the at least one side of the chamber is a material selected from the group consisting of clear, transparent, translucent, and semi-transparent materials; and d) a port to the chamber for accessing the lighting unit, wherein the port is located through and accessible from the front end of the waterfall apparatus, and wherein the port is separate from the waterfall slot, wherein the lighting unit has a length that is substantially the same length as the chamber length, and wherein the lighting unit is accessible through the port.

11. The waterfall apparatus as claimed in claim 10, wherein the chamber is oriented to run adjacent to the waterfall slot at the front end of the waterfall apparatus.

12. The waterfall apparatus as claimed in claim 11, wherein the waterfall slot and the chamber are located at a position on the front end of the waterfall apparatus such that the waterfall that emanates through the waterfall slot, out of the waterfall outlet, falls directly into a spa tub.

13. The waterfall apparatus as claimed in claim 10, wherein the lighting unit has a connector that cooperates with a connector on the waterfall apparatus whereby the lighting unit can be connected to and disconnected from the connector on the waterfall apparatus for removing the lighting unit from the waterfall apparatus and installing a different lighting unit into the waterfall apparatus.

14. The waterfall apparatus as claimed in claim 11, wherein the waterfall outlet comprises a serrated edge or floor located at a position on the waterfall apparatus proximal to or at the waterfall slot at the front end of the waterfall apparatus such that the waterfall that emanates out of the waterfall slot flows over the serrated edge, wherein the serrated edge adds turbulence to the waterfall in a controlled manner to create a waterfall flow pattern, whereby light is dispersed through the waterfall flow pattern.

15. The waterfall apparatus as claimed in claim 12, wherein the waterfall outlet comprises a serrated edge or floor located at a position on the waterfall apparatus proximal to or at the waterfall slot at the front end of the waterfall apparatus such that the waterfall that emanates out of the waterfall slot flows over the serrated edge, wherein the serrated edge adds turbulence to the waterfall in a controlled manner to create a waterfall flow pattern, whereby light is dispersed through the waterfall flow pattern.

* * * * *